US009406993B2

(12) United States Patent
Hendry et al.

(10) Patent No.: US 9,406,993 B2
(45) Date of Patent: Aug. 2, 2016

(54) FILTER

(75) Inventors: David Robert Hendry, Brisbane (AU); Steven John Cooper, Brisbane (AU); Peter Blakeborough Kenington, Chepstow (GB)

(73) Assignee: Mesaplexx Pty Ltd, Queensland (AU)

( * ) Notice: Subject to any disclaimer, the term of this patent is extended or adjusted under 35 U.S.C. 154(b) by 343 days.

(21) Appl. No.: 13/531,169

(22) Filed: Jun. 22, 2012

(65) Prior Publication Data

US 2013/0049898 A1 Feb. 28, 2013

Related U.S. Application Data

(60) Provisional application No. 61/531,277, filed on Sep. 6, 2011.

(30) Foreign Application Priority Data

Aug. 23, 2011 (AU) ..... 2011903389

(51) Int. Cl.
*H01P 1/208* (2006.01)
*H01P 7/10* (2006.01)
*H01P 1/20* (2006.01)

(52) U.S. Cl.
CPC ..... *H01P 7/105* (2013.01); *H01P 1/2088* (2013.01); *H01P 1/2002* (2013.01); *H01P 1/2086* (2013.01); *Y10T 29/49016* (2015.01)

(58) Field of Classification Search
CPC ..... H01P 7/105; H01P 1/20; H01P 1/2086; H01P 7/06; H01P 1/2088
USPC ..... 333/202, 219.1, 227, 230
See application file for complete search history.

(56) References Cited

U.S. PATENT DOCUMENTS 2,890,421 A 6/1959 Currie
3,657,670 A 4/1972 Kitazume et al. ..... 333/73 W
4,142,164 A 2/1979 Nishikawa et al.

(Continued)

FOREIGN PATENT DOCUMENTS

CA 1159154 A2 6/1985
CA 1194157 A1 9/1985

(Continued)

OTHER PUBLICATIONS

Awai, Ikuo, et al; Equivalent-Circuit Representation and Explanation of Attenuation Poles of a Dual-Mode Dielectric-Resonator Bandpass Filter; Transactions on Microwave Theory and Techniques; (Dec. 1998); pp. 2159-2163; vol. 46; No. 12; IEEE.

(Continued)

*Primary Examiner* — Robert Pascal
*Assistant Examiner* — Gerald Stevens
(74) *Attorney, Agent, or Firm* — Harrington & Smith

(57) ABSTRACT

A cavity filter, including a dielectric resonator structure comprising a piece of dielectric material having a shape such that it can support a first resonant mode and a second resonant mode which is substantially degenerate with the first resonant mode; and a coupling structure for exciting a resonant mode within the piece of dielectric material or extracting energy from a resonant mode within the piece of dielectric material; wherein the coupling structure consists of a single patch element in contact with a surface of the piece of dielectric material, the patch element being arranged to couple directly to said first and second resonant modes simultaneously.

12 Claims, 9 Drawing Sheets

(56) References Cited

U.S. PATENT DOCUMENTS

| | | | | |
|---|---|---|---|---|
| 4,614,920 | A | 9/1986 | Tong | |
| 4,622,523 | A | 11/1986 | Tang | |
| 4,623,857 | A | 11/1986 | Nishikawa et al. | |
| 4,630,009 | A | 12/1986 | Tang | |
| 4,644,305 | A | 2/1987 | Tang et al. | |
| 4,675,630 | A | 6/1987 | Tang et al. | |
| 4,792,771 | A | 12/1988 | Sin | |
| 4,879,533 | A | 11/1989 | de Muro et al. | 333/206 |
| 4,963,844 | A | 10/1990 | Konishi et al. | 333/208 |
| 5,023,866 | A | 6/1991 | De Muro | 370/24 |
| 5,307,036 | A * | 4/1994 | Turunen et al. | 333/202 |
| 5,325,077 | A | 6/1994 | Ishikawa et al. | 333/219.1 |
| 5,585,331 | A | 12/1996 | Mansour et al. | |
| 5,589,807 | A | 12/1996 | Tang | |
| 5,710,530 | A | 1/1998 | Wada et al. | |
| 5,731,751 | A | 3/1998 | Vangala | |
| 5,805,035 | A | 9/1998 | Accatino et al. | |
| 5,821,837 | A | 10/1998 | Accatino et al. | |
| 6,005,457 | A | 12/1999 | Wu | |
| 6,016,091 | A | 1/2000 | Hidaka et al. | 333/202 |
| 6,025,291 | A * | 2/2000 | Murakawa | 501/136 |
| 6,066,996 | A | 5/2000 | Goertz et al. | |
| 6,072,378 | A | 6/2000 | Kurisu et al. | |
| 6,133,808 | A | 10/2000 | Arakawa | 333/134 |
| 6,160,463 | A | 12/2000 | Arakawa et al. | 333/202 |
| 6,278,344 | B1 | 8/2001 | Kurisu et al. | |
| 6,346,867 | B2 | 2/2002 | Arakawa et al. | 333/208 |
| 6,462,629 | B1 | 10/2002 | Blair et al. | |
| 6,549,094 | B2 | 4/2003 | Takagi et al. | 333/134 |
| 6,677,837 | B2 | 1/2004 | Kojima et al. | 333/208 |
| 6,762,658 | B1 | 7/2004 | Isomura et al. | 333/202 |
| 6,825,740 | B2 | 11/2004 | Kundu | 333/202 |
| 6,834,429 | B2 | 12/2004 | Blair et al. | |
| 6,853,271 | B2 | 2/2005 | Wilber et al. | |
| 6,897,741 | B2 | 5/2005 | Ando et al. | |
| 6,954,122 | B2 | 10/2005 | Wilber et al. | |
| 7,042,314 | B2 | 5/2006 | Wang et al. | 333/202 |
| 7,068,127 | B2 | 6/2006 | Wilber et al. | |
| 7,138,891 | B2 | 11/2006 | Andoh et al. | |
| 7,605,678 | B2 | 10/2009 | Ando et al. | |
| 7,755,456 | B2 | 7/2010 | Salehi | |
| 8,022,792 | B2 | 9/2011 | Howard | |
| 8,325,077 | B2 | 12/2012 | Gentric | 341/173 |
| 2001/0000429 | A1 | 4/2001 | Arakawa et al. | |
| 2001/0024147 | A1 * | 9/2001 | Arakawa et al. | 333/135 |
| 2002/0024410 | A1 | 2/2002 | Guglielmi et al. | |
| 2002/0039058 | A1 | 4/2002 | Sano et al. | |
| 2003/0006864 | A1 | 1/2003 | Hattori et al. | |
| 2003/0090344 | A1 | 5/2003 | Wang et al. | |
| 2003/0141948 | A1 | 7/2003 | Maekawa et al. | |
| 2003/0227360 | A1 | 12/2003 | Kirihara et al. | |
| 2004/0041660 | A1 | 3/2004 | Kawahara et al. | |
| 2004/0056736 | A1 | 3/2004 | Enokihara et al. | |
| 2005/0128031 | A1 * | 6/2005 | Wilber | H01P 1/2082 333/202 |
| 2005/0140474 | A1 | 6/2005 | Kim et al. | |
| 2005/0253672 | A1 | 11/2005 | Enokihara et al. | |
| 2006/0139127 | A1 | 6/2006 | Wada et al. | |
| 2008/0018391 | A1 * | 1/2008 | Bates | 327/557 |
| 2008/0061905 | A1 | 3/2008 | Ishikawa | |
| 2008/0211601 | A1 | 9/2008 | Bates | |
| 2010/0231323 | A1 | 9/2010 | Vangala et al. | |
| 2011/0006856 | A1 | 1/2011 | Kim et al. | |
| 2011/0128097 | A1 | 6/2011 | Park et al. | |
| 2014/0077900 | A1 | 3/2014 | Rogozine et al. | |

FOREIGN PATENT DOCUMENTS

| | | | |
|---|---|---|---|
| EP | 0883203 | A3 | 10/1999 |
| JP | H0216801 | | 1/1990 |
| JP | H-10284988 | | 1/1998 |
| JP | H-1079636 | | 3/1998 |
| JP | H-10209808 | | 8/1998 |
| JP | H-10224113 | | 8/1998 |
| JP | H-10294644 | | 11/1998 |
| JP | H-10322161 | | 12/1998 |
| JP | 2000295072 | A | 10/2000 |
| JP | 2001060804 | A | 3/2001 |
| JP | 2001060805 | A | 3/2001 |
| JP | 2001160702 | A | 6/2001 |
| JP | 2002135003 | A | 5/2002 |
| JP | 2002151906 | A | 5/2002 |
| JP | 2002217663 | A | 8/2002 |
| JP | 2003037476 | A | 2/2003 |
| JP | 2003188617 | A | 7/2003 |
| JP | 2003234635 | A | 8/2003 |
| JP | 2004312287 | A | 11/2004 |
| JP | 2004312288 | A | 11/2004 |
| JP | 2005065040 | A | 3/2005 |
| JP | 2005167577 | A | 6/2005 |
| JP | 2005223721 | A | 8/2005 |
| WO | WO-9301626 | A1 | 1/1993 |
| WO | WO-0077883 | A1 | 12/2000 |
| WO | WO-02078119 | A1 | 10/2002 |

OTHER PUBLICATIONS

Awai, Ikuo, et al; Coupling of Dual Modes in a Dielectric Waveguide Resonator and its Application to Bandpass Filters; Proceedings of teh 25TH European Microwave Conference; (1995): pp. 533-537; Conf. 25; Yamaguchi University, Japan.

Wetly, Andrew R, et al; Rotationally Symmetric FDTD for Fast Design and Wideband Spurious Performance Prediction of Dielectric Resonator Filters; Telecom Group, Faculty of Engineering, University of Technology; (1999); pp. 844-847.

Chaudhary, Raghvendra Kumar, et al.; Multi-Layer Multi-Permittivity Dielectric Resonator: A New Approach for Improved Spurious Free Window; Proceedings of the 40TH European Microwave Conference; (Sep. 28-30, 2010); pp. 1194-1197; Paris, France.

Sano, Kazuhisa, et al.; Application of the Planar I/O Terminal to Dual Mode Dielectric Waveguide Filters; International Microwave Symposium Digest: (Jun. 11-16, 2000); pp. 1173-1176; Boston, MA.

Wang, Chi, et al; A Practical Triple-Mode Monoblock Bandpass Filter for Base Station Applications; MTT-S Digest; (2001); pp. 1783-1786.

Awai, Ikuo, et el; A Dual Mode Dielectric Waveguide Resonator and its Application to Bandpass Filters; IEICE Transactions on Electronics; (Aug. 1995); pp. 1018-1025; vol. E78-C; No. 8.

Bekheit, Maged, et al.; Modeling and Optimization of Compact Microwave Bandpass Filters; IEEE Transactions of Microwave Theory and Techniques; (Feb. 2008); pp. 420-430; vol. 56; No. 2.

Dupont, "Properties Handbook", Dupont, p. 4 (30 pgs.), Nov. 2003.

Trak Ceramics, "Dielectric Materials", Trak Ceramics, Inc., p. 1 (8 pgs.), Jun. 2001.

* cited by examiner

FILTER

CROSS REFERENCE TO RELATED APPLICATIONS

The present application is related to and claims the benefit of Australian Provisional Patent Application No. 2011903389, filed Aug. 23, 2011 and U.S. Provisional Patent Application No. 61/531,277, filed Sep. 6, 2011, both of whose disclosures are hereby incorporated by reference in their entirety into the present disclosure.

TECHNICAL FIELD

The present invention relates to filters, and in particular to a filter including a resonator body for use, for example, in frequency division duplexers for telecommunication applications.

BACKGROUND

The reference in this specification to any prior publication (or information derived from it), or to any matter which is known, is not, and should not be taken as an acknowledgment or admission or any form of suggestion that the prior publication (or information derived from it) or known matter forms part of the common general knowledge in the field of endeavour to which this specification relates.

All physical filters essentially consist of a number of energy storing resonant structures, with paths for energy to flow between the various resonators and between the resonators and the input/output ports. The physical implementation of the resonators and the manner of their interconnections will vary from type to type, but the same basic concept applies to all. Such a filter can be described mathematically in terms of a network of resonators coupled together, although the mathematical topography does not have to match the topography of the real filter.

Conventional single-mode filters formed from dielectric resonators are known. Dielectric resonators have high-Q (low loss) characteristics which enable highly selective filters having a reduced size compared to cavity filters. These single-mode filters tend to be built as a cascade of separated physical dielectric resonators, with various couplings between them and to the ports. These resonators are easily identified as distinct physical objects, and the couplings tend also to be easily identified.

Single-mode filters of this type may include a network of discrete resonators formed from ceramic materials in a "puck" shape, where each resonator has a single dominant resonance frequency, or mode. These resonators are coupled together by providing openings between cavities in which the resonators are located. Typically, the resonators provide transmission poles or "zeros", which can be tuned at particular frequencies to provide a desired filter response. A number of resonators will usually be required to achieve suitable filtering characteristics for commercial applications, resulting in filtering equipment of a relatively large size.

One example application of filters formed from dielectric resonators is in frequency division duplexers for microwave telecommunication applications. Duplexers have traditionally been provided at base stations at the bottom of antenna supporting towers, although a current trend for microwave telecommunication system design is to locate filtering and signal processing equipment at the top of the tower to thereby minimise cabling lengths and thus reduce signal losses. However, the size of single mode filters as described above can make these undesirable for implementation at the top of antenna towers.

Multi-mode filters implement several resonators in a single physical body, such that reductions in filter size can be obtained. As an example, a silvered dielectric body can resonate in many different modes. Each of these modes can act as one of the resonators in a filter. In order to provide a practical multi-mode filter it is necessary to couple the energy between the modes within the body, in contrast with the coupling between discrete objects in single mode filters, which is easier to control in practice.

The usual manner in which these multi-mode filters are implemented is to selectively couple the energy from an input port to a first one of the modes. The energy stored in the first mode is then coupled to different modes within the resonator by introducing specific defects into the shape of the body. In this manner, a multi-mode filter can be implemented as an effective cascade of resonators, in a similar way to conventional single mode filter implementations. Again, this technique results in transmission poles which can be tuned to provide a desired filter response.

An example of such an approach is described in U.S. Pat. No. 6,853,271, which is directed towards a triple-mode mono-body filter. Energy is coupled into a first mode of a dielectric-filled mono-body resonator, using a suitably configured input probe provided in a hole formed on a face of the resonator. The coupling between this first mode and two other modes of the resonator is accomplished by selectively providing corner cuts or slots on the resonator body.

This technique allows for substantial reductions in filter size because a triple-mode filter of this type represents the equivalent of a single-mode filter composed of three discrete single mode resonators. However, the approach used to couple energy into and out of the resonator, and between the modes within the resonator to provide the effective resonator cascade, requires the body to be of complicated shape, increasing manufacturing costs.

Two or more triple-mode filters may still need to be cascaded together to provide a filter assembly with suitable filtering characteristics. As described in U.S. Pat. Nos. 6,853,271 and 7,042,314 this may be achieved using a waveguide or aperture for providing coupling between two resonator mono-bodies. Another approach includes using a single-mode combline resonator coupled between two dielectric mono-bodies to form a hybrid filter assembly as described in U.S. Pat. No. 6,954,122. In any case the physical complexity and hence manufacturing costs are even further increased.

SUMMARY OF INVENTION

According to a first aspect of the present invention, there is provided a cavity filter, comprising: a dielectric resonator structure comprising a piece of dielectric material having a shape such that it can support a first resonant mode and a second resonant mode which is substantially degenerate with the first resonant mode; and a coupling structure for exciting a resonant mode within the piece of dielectric material or extracting energy from a resonant mode within the piece of dielectric material; wherein the coupling structure consists of a single patch element in contact with a surface of the piece of dielectric material, the patch element being arranged to couple directly to said first and second resonant modes simultaneously.

The single patch element may consist of a substantially flat conductive element.

The substantially flat conductive element may be adapted for generating an electric field at least partially for exciting the first resonant mode and a magnetic field at least partially for exciting the second resonant mode, or at least partially for extracting energy from an electric field of the first resonant mode and a magnetic field of the second resonant mode.

The cavity filter may further comprise a feedpoint connected to the patch element for feeding input signals to the patch element or receiving output signals from the patch element. The feedpoint may be connected to the patch element at a location displaced from an electrical centre of the patch element.

The patch element may be located in a face of the piece of dielectric material, and the feedpoint may be displaced from the electrical centre of the patch element in a direction which is neither parallel nor perpendicular to sides of the face.

The feedpoint may be a first feedpoint, and the cavity filter further comprises a second feedpoint connected to the patch element. The first and second feedpoints may be connected to the substantially flat conductive element so as to generate a circularly polarized field. Alternatively, or additionally, the first and second feedpoints may be connected to the substantially flat conductive element so as to generate a first linearly polarized field and a second linearly polarized field.

The patch element may be located in a face of the piece of dielectric material. The patch element may be located at a position which is offset from a centre of the face, and may be offset from a centre of the face in a direction which is neither perpendicular nor parallel to sides of the face.

The shape of the piece of dielectric material may be such that excitation of the first resonant mode causes excitation of the second resonant mode.

The piece of dielectric material may have a regular shape with one or more defects in order to couple energy between the first and second resonant modes. The one or more defects may comprise one or more of the following: a recess or hole in the piece of dielectric material; and a protuberance of dielectric material.

The shape of the piece of dielectric material is such that the first resonant mode and the second resonant mode are capable of being simultaneously independently excited.

The piece of dielectric material may be covered by a layer of conductive material, the layer of conductive material having an aperture in which the coupling structure is located.

The piece of dielectric material may be a first piece of dielectric material, and may further comprise a second piece of dielectric material operably coupled to the first piece of dielectric material. The first piece of dielectric material may be covered by a first layer of conductive material, and the second piece of dielectric material may be covered by a second layer of conductive material. The first and second layers of conductive material may comprise coupling apertures through which energy can be passed from the first piece of dielectric material to the second piece of dielectric material and vice versa. A conductive patch element may be located in the coupling apertures.

The coupling structure may be a first coupling structure for exciting a resonant mode within the piece of dielectric material or extracting energy from a resonant mode within the piece of dielectric material, and the cavity filter further comprises a second coupling structure for extracting energy from a resonant mode within the piece of dielectric material or extracting energy from a resonant mode within the piece of dielectric material. The second coupling structure may consist of a second single patch element in contact with a second, different surface of the piece of dielectric material. Alternatively, the second coupling may be in contact only with the first surface of the piece of dielectric material.

The single patch element may have a shape arranged to couple to the first and second resonant mode via at least one of E-field excitation and H-field excitation.

The piece of dielectric material may be cuboid.

According to another embodiment, a cavity filter may comprise: a dielectric resonator structure comprising a piece of dielectric material having a shape such that it can support a first resonant mode and a second resonant mode which is substantially degenerate with the first resonant mode; and a coupling structure for exciting a resonant mode within the piece of dielectric material or extracting energy from a resonant mode within the piece of dielectric material; wherein the coupling structure consists of a single patch element in contact with a surface of the piece of dielectric material.

The conductive element may have a shape adapted for exciting only the first resonant mode within the piece of dielectric material or extracting energy from the first resonant mode within the piece of dielectric material.

A feedpoint may be connected to the patch element for feeding input signals to the patch element or receiving output signals from the patch element. The feedpoint may be connected to the patch element at a location coincident with an electrical centre of the patch element. Alternatively, the feedpoint may be connected to the patch element at a location displaced from an electrical centre of the patch element, or connected to the patch element at a location displaced from an electrical centre of the patch element along a direction parallel or perpendicular to a side of the piece of dielectric material.

The shape of the piece of dielectric material may be such that excitation of the first resonant mode causes excitation of the second resonant mode. The piece of dielectric material may have a regular shape with one or more defects in order to couple energy between the first and second resonant modes. The one or more defects may comprise one or more of the following: a recess or hole in the piece of dielectric material; and a protuberance of dielectric material.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1A:
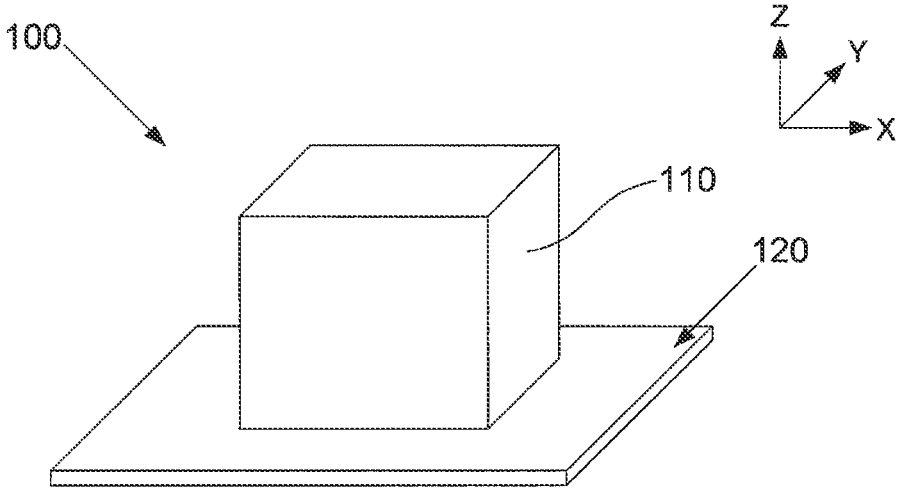
FIG. 1A is a schematic perspective view of an example of a multi-mode filter.
Figure 1B:
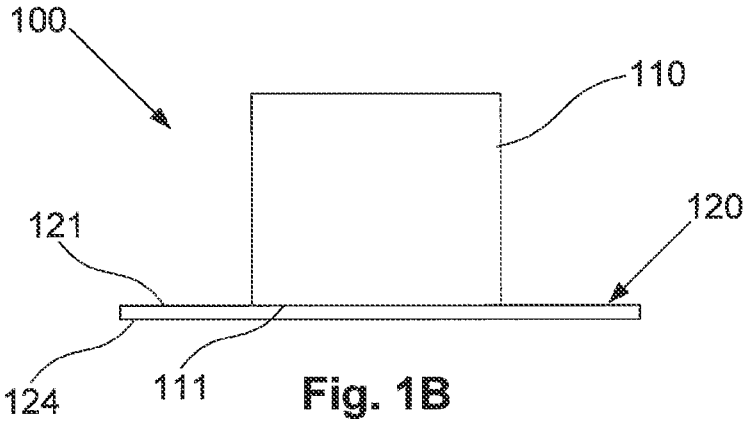
FIG. 1B is a schematic side view of the multi-mode filter of FIG. 1A.
Figure 1C:
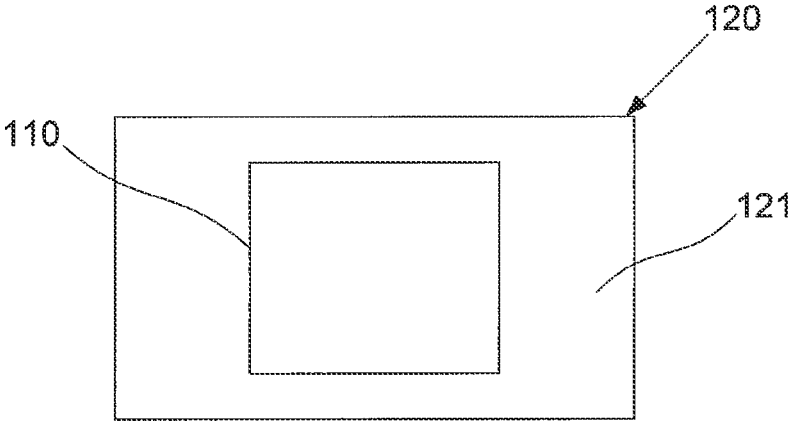
FIG. 1C is a schematic plan view of the multi-mode filter of FIG. 1A.

An example of a multi-mode filter will now be described with reference to FIGS. 1A to 1F.

In this example, the filter 100 includes a resonator body 110, a substrate 120 and a coupling structure 130. The coupling structure 130 consists of a single conductive patch element 131 extending adjacent at least part of a surface 111 of the resonator body 110. As will be described in greater detail below, the coupling structure 130 allows for coupling of signals to or from the resonator body 110 and, depending on the coupling structure 130 and the shape of the resonator body 110, may provide coupling to a plurality of resonance modes of the resonator body.

In use, a signal can be supplied to or received from the conductive patch element 131. In a suitable configuration, this allows a signal to be filtered to be supplied to the resonator body 110 for filtering, or can allow a filtered signal to be obtained from the resonator body, as will be described in more detail below.

In the above example, the coupling structure 130 includes a single conductive patch element 131, coupled to a signal path 141, allowing the coupling patch to couple input or output signals to or from the resonator body 110 as necessary. Thus, in one embodiment a signal may be supplied to the patch 131 via the path 141 in order to couple the signal to the resonance modes of the resonator body 110. In another embodiment, a filtered signal may be output from the patch 131 through the path 141.

Thus one signal is supplied to, or received from, the resonator body 110 by way of the coupling structure 130. A further signal may be otherwise coupled to the resonator body 110 as described below. Briefly, this can be achieved if the resonator body 110 is positioned in contact with, or otherwise coupled to, another resonator body, thereby allowing signals to be received from or supplied to the other resonator body. Alternatively, multiple coupling structures 130 may be provided, with each coupling structure 130 having a corresponding single patch element. For example, different coupling structures can be provided on different surfaces of the resonator body 110. Further details of the coupling structure are provided below.

Typically the resonator body 110 includes, and more typically is manufactured from, a solid body 112 of a dielectric material having suitable dielectric properties. In one example, the resonator body is a ceramic material, although this is not essential and alternative materials can be used. Additionally, the body can be a multilayered body including, for example, layers of materials having different dielectric properties. In one example, the body can include a core of a dielectric material, and one or more outer layers of different dielectric materials.

The resonator body 110 includes an external coating of conductive material 114, such as silver, although other materials could be used such as gold, copper, or the like. The conductive material may be applied to one or more surfaces of the body. A region 116 of the surface adjacent the coupling structure 130 may be uncoated to allow coupling of signals to the resonator body 110.

Figure 1D:
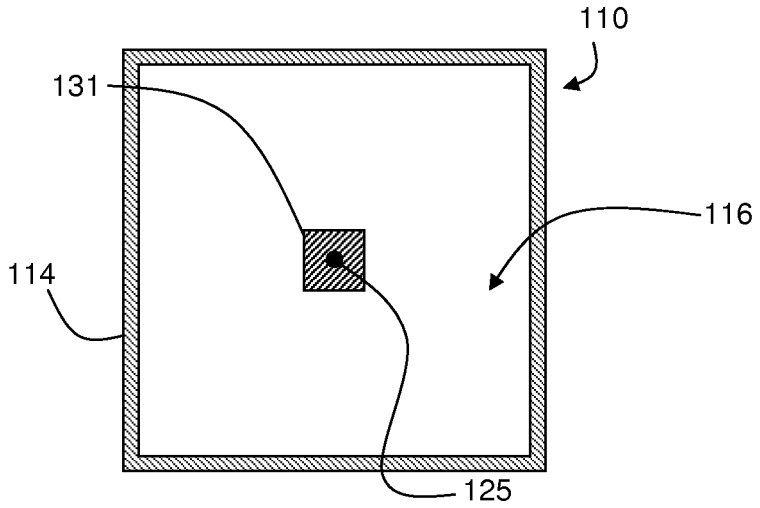
FIG. 1D is a schematic plan view of an example of the underside of the resonator body of FIG. 1A including a coupling structure.
Figure 1E:
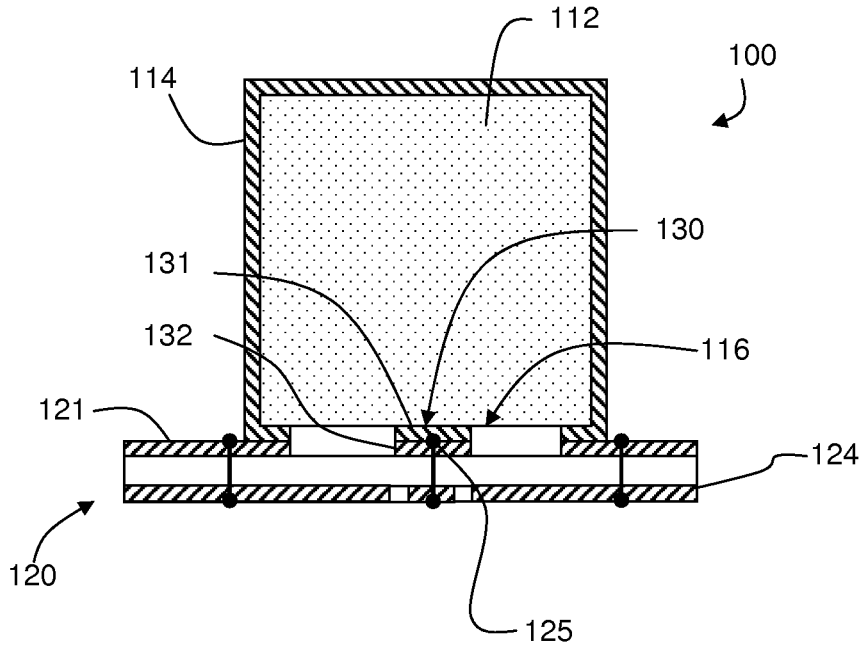
FIG. 1E is a cross section through the filter.
Figure 1F:
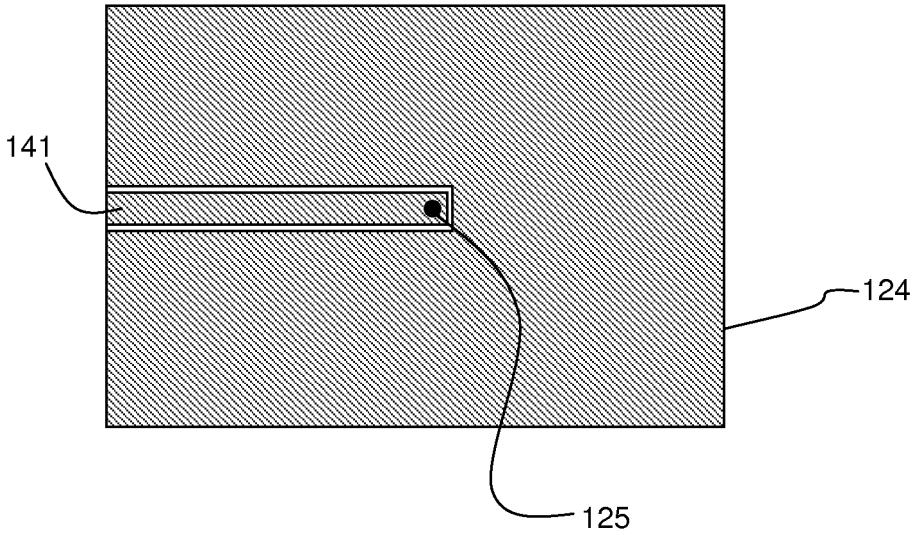
FIG. 1F is a schematic underside view of an example of the substrate of FIG. 1A including input or output connections.

In the illustrated embodiment, the coupling structure 130 is provided on a surface of the dielectric resonator 112 directly, as shown in FIGS. 1D and 1E. That is, the resonator body 110 may be coated in a layer 114 of conductive material as described above; a coupling structure according to embodiments of the present invention can then be patterned into the layer of conductive material, and coupled to a connection pad 132 on an uppermost surface of the substrate 120. In that case, the coupling between the substrate 120 and the coupling structure on the resonator body may be provided by way of solder ball contacts or any other suitable means. The coupling structure can be formed using one of the standard techniques known to those skilled in the art, such as by patterning a mask (using printing techniques or photoresist) and then etching the exposed parts to create the coupling structure. Alternatively the coupling structure may be milled into the conductive layer surrounding the resonator body 110.

Alternatively, the coupling structure 130 may be provided on the substrate 120. In that case, the coupling structure can be formed in an upper conductive layer of the substrate using any of the standard techniques known to those skilled in the art, such as by patterning a mask in the layer (using printing techniques or photoresist) and then etching the exposed parts to create one or more cut-outs, or by milling the conductive layer.

The resonator body can be any shape, but generally defines at least two orthogonal axes, with the coupling paths extending at least partially in the direction of each axis, to thereby provide coupling to multiple separate resonance modes.

Figure 2A:
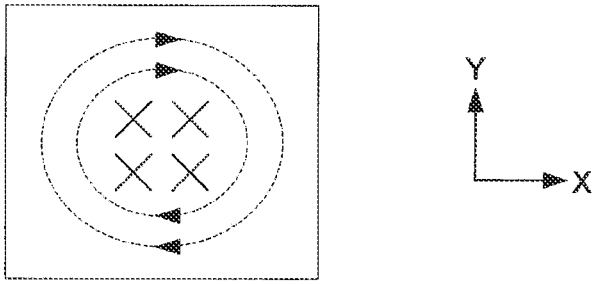
FIGS. 2A to 2C are schematic diagrams of examples the resonance modes of the resonator body of FIG. 1A.
Figure 2B:
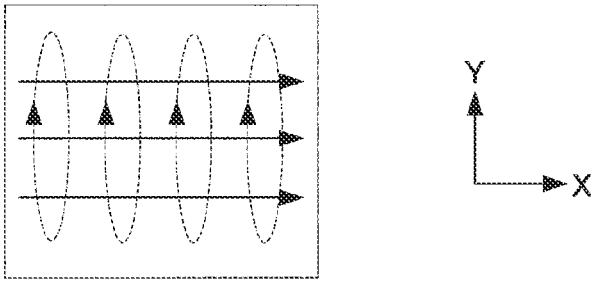
Figure 2C:
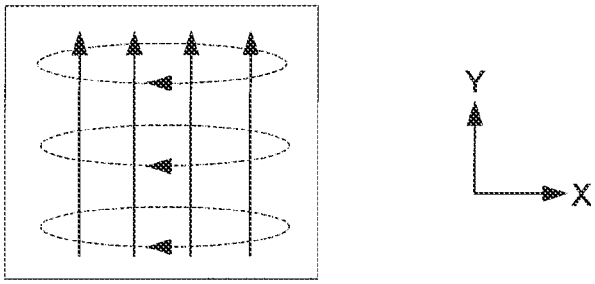

In the current example, the resonator body 110 is a cuboid body, and therefore defines three orthogonal axes substantially aligned with surfaces of the resonator body, as shown by the axes X, Y, Z. As a result, the resonator body 110 has three dominant resonance modes that are substantially orthogonal and substantially aligned with the three orthogonal axes. Examples of the different resonance modes are shown in FIGS. 2A to 2C, which show magnetic and electrical fields in dotted and solid lines respectively, with the resonance modes being generally referred to as TM110, TE011 and TE101 modes, respectively.

Cuboid structures are particularly advantageous as they can be easily and cheaply manufactured, and can also be easily fitted together, for example by arranging multiple resonator bodies in contact. Cuboid structures typically have clearly defined resonance modes, making configuration of the coupling structure more straightforward. Additionally, the use of a cuboid structure provides a planar surface 111 so that the coupling structure 130 can be arranged in a plane parallel to the planar surface 111, with the patch element 131 optionally being in contact with the resonator body 110. This can help maximise coupling between the coupling structure 130 and resonator body 110, as well as allowing the coupling structure 130 to be more easily manufactured.

The provision of a planar surface 111 allows the substrate 120 to be a planar substrate, such as a printed circuit board (PCB) or the like. In the illustrated embodiment (see FIG. 1E in particular), the PCB substrate 120 has two layers. However, it will be apparent to those skilled in the art that the PCB 120 may comprise any number of further layers (for example, providing an inner signal layer, a power layer, or further ground layers) without departing from the scope of the present invention. Note that the phrase "number of layers" as used herein refers to the number of conductive layers as is the convention in the art. Each conductive layer is separated by a non-conductive layer of, for example, a material having low dielectric constant.

An uppermost layer (i.e. one of the outermost layers) of the PCB substrate 120 comprises a ground plane 121 having an aperture through which signals can be transferred to and/or from the resonator body 110. In the illustrated embodiment, the aperture in the substrate ground plane 121 substantially corresponds in size and shape to the aperture 116 in the conductive layer 114 covering the resonator body 110. In other embodiments, the aperture in the substrate ground plane 121 may correspond in shape to the aperture 116 in the conductive layer 114, but have a greater or smaller size. A connection pad 132 (or, in alternative embodiments, the coupling structure 130 itself) is arranged within the aperture. This is electrically coupled by a connection 125 to the input/output external connection 141 such that signals can be passed to or from the resonator body 110. The connection 125 may be a standard via or plated through-hole, as will be familiar to those skilled in the art. It will be apparent from FIGS. 1D and 1E that the connection 125 is connected to the connection pad 132 (and hence the patch element 131) at a location which is coincident with an electrical centre of the patch element. In other embodiments this may not be the case, as will be described below with respect to FIGS. 3A to 3G.

The bottom layer comprises a further ground plane 124, which is arranged so as to cover the aperture 116 as will be described in further detail.

The conductive layer 114 covering the resonator body 110 is electrically connected to the upper ground plane 121. Solder is suitable for this task as it provides both electrical and mechanical connection, but any other suitable connection mechanism may be employed. The upper ground plane 121 is further electrically coupled to the lower ground plane 124, which extends over the aperture 116 (albeit at a position removed from the aperture itself). In this manner, a near continuous ground plane is established around the dielectric resonator 112, and energy leakage from the filter 100 is reduced or minimized. The conductive layer 114 surrounding the resonator 112 prevents energy from radiating out of the dielectric material from surfaces on which the conductive layer 114 is present. The electrical coupling between the upper and lower ground planes 121, 124 prevents energy from leaking out of the aperture 116, except of course the controlled extraction of energy by the coupling structure 130 corresponding to output signals.

The manner of the electrical coupling between the upper and lower ground planes 121, 124 may vary according to the frequencies of the input and output signals. That is, in one embodiment the upper and lower ground planes 121, 124 are coupled to each other by one or more electrical connections such as vias or plated through holes, as will be familiar to those skilled in the art. The electrical connections may be distributed so as to largely correspond with the boundary of the aperture 116. However, the number of such electrical connections, as well as their precise positioning, may be altered according to the frequencies of the signals which will be input to and/or output from the resonator body 110. If sufficient connections are used, based upon the frequencies present in the circuit, then the lower ground plane 124 forms the final (i.e. $6^{th}$ in the illustrated embodiment) conductive side to the resonator 'box'. This grounded, conductive, side acts as a reflector, in the same manner as the metallised sides of the resonator body 110. The electromagnetic energy is therefore kept within the structure and prevented from radiating outwards.

In alternative embodiments a ground plane may not be provided, in which case the patch element 131 could be formed from conductive material applied to the substrate 120. In this instance, the conductive patch element 131 can still be electrically coupled to ground, for example via vias or other connections provided on the substrate.

The input or output is provided in the form of a conductive path 141 provided on an underside of the substrate 120, typically defined by a cut-out in the ground plane 124. The input or output may in turn be coupled to additional connections depending on the intended application. For example, the input or output path 141 could be connected to an edge-mount SMA coaxial connector, a direct coaxial cable connection, a surface mount coaxial connection, a chassis mounted coaxial connector, or a solder pad to allow the filter 100 to be directly soldered to another PCB, with the method chosen depending on the intended application. Alternatively the filter could be integrated into the PCB of other components of a communications system.

In the above example, the input or output path 141 is provided on an underside of the substrate. However, in this instance, the path 141 is not enclosed by a ground plane. Accordingly, in an alternative example, a dual layered PCB can be used, with the input or output path 141 embedded as a transmission line inside the PCB, with the top and underside surfaces providing a continuous ground plane. This has the virtue of providing full shielding of the inner parts of the filter, and also allows the filter to be mounted to a conducting or non-conducting surface, as convenient.

The input or output path 141 can be coupled to the patch element 131 using any suitable technique, such as capacitive or inductive coupling, although in the illustrated example this is achieved using an electrical connection 125, such as a connecting via, extending through the substrate 120.

In use, the coupled resonance modes of the resonator body provide respective energy paths between the input and output. Furthermore, the input coupling path and the output coupling path can be configured to allow coupling therebetween to provide an energy path separate to energy paths provided by the resonance modes of the resonator body. This can provide four parallel energy paths between the input and the output. These energy paths can be arranged to introduce at least one transmission zero to the frequency response of the filter, as will be described in more detail below. In this regard, the term "zero" refers to a transmission minimum in the frequency response of the filter, meaning transmission of signals at that frequency will be minimal, as will be understood by persons skilled in the art.

Example coupling structures will now be described with reference to FIGS. 1D and 3A to 3G. It will be appreciated that the coupling structures may be formed in the substrate 120 or in a coating of the resonator body 110 as described above. Traditional arrangements of coupling structures include a probe extending into the resonator body, as described for example in U.S. Pat. No. 6,853,271. In such arrangements, most of the coupling is capacitive, with some inductive coupling also present due to the changing currents flowing along the probe. If the probe is short, this effect will be small. Whilst such a probe can provide reasonably strong coupling, this tends to be with a single mode only, unless the shape of the resonant structure is modified. For a cubic resonator body, the coupling for each of the modes is typically as shown in Table 1 below.

TABLE 1

| Mode | H field coupling | E field coupling | Notes |
|---|---|---|---|
| TE 011 (E along X) | Negligible or zero due to tiny and orthogonal field. | Negligible or zero due to symmetry. | Negligible coupling |
| TE 101 (E along Y) | Negligible or zero due to tiny and orthogonal field. | Negligible or zero due to symmetry. | Negligible coupling |
| TM 110 (E along Z) | Some for long probe | strong | Strong coupling |

Furthermore, a probe has the disadvantage of requiring a hole to be bored into the cube.

An alternative is to use a surface patch, as shown for example in FIG. 1D. Surface patches are easier to manufacture (and hence cheaper), but are also simpler to design. The design process can be carried out using relatively simple calculations rather than the complex simulation software of other coupling structures. In this example the patch 131 is square; however, in general the patch may take any regular (e.g. circular) or irregular shape. The feedpoint (i.e. the location at which the input signals are provided to the patch or from which output signals are extracted from the patch) coincides with the centre (i.e. electrical centre) of the patch. When driven from an appropriate feedpoint near to their electrical centre, such patches generate primarily an electric field extending into the resonator body 110. H (i.e. magnetic) fields are also generated if the patch has an elongate shape, but in this instance any coupling to low-order H field modes is substantially cancelled due to the central feedpoint.

In the above description, the term 'electrical centre' is defined as: the position of the voltage anti-node in the lowest-order radial current mode of the patch.

The term 'patch' can cover a range of sizes and shapes of coupling structure, including both compact and elongated structures, as discussed above. It is important, therefore, to define what constitutes a 'patch' and to distinguish it from a feedline (which is not an intentional coupling structure) or a probe (which is an intentional coupling structure, but is clearly not a patch). In this context, a patch is any coupling structure for which its width (or narrowest overall X-Y dimension) is greater than the width of the feed structure (e.g. stripling, microstrip, waveguide, coax, PCB via etc.) which transports energy to or from it.

In the above description of patch operation and in all subsequent descriptions of patch operation encompassed by this invention (unless otherwise stated explicitly), the size of the patch is assumed to be close to, or at, that required to produce resonance within the patch, at the input or output frequency of interest. If a patch is designed which is significantly larger or smaller than that required to produce resonance within the patch, at the input or output frequency of interest, then a different behaviour to that described, in general, by this invention description will be experienced. Such larger or smaller patches also fall within the scope of the invention. However, their behaviour will differ from that described.

The modes of coupling for a centre-fed, substantially square patch, located at the centre of one side of the resonator body 110, are summarised in Table 2, and in general this succeeds in only weakly coupling with a single mode. Despite this, coupling into a single mode only can prove useful, for example if multiple coupling paths are to be provided on different surfaces to each couple only to a single respective mode. This could be used, for example, to allow multiple inputs and or outputs to be provided. A further alternative is to couple only to a single mode of the resonator body 110, but to shape the resonator body 110 such that that mode is coupled to one or more of the other modes. This possibility will be explored further in FIG. 4 and the related description.

TABLE 2

| Mode | H field coupling | E field coupling | Notes |
|---|---|---|---|
| TE 011 (E along X) | none | Negligible or zero due to symmetry | Negligible coupling |
| TE 101 (E along Y) | none | Negligible or zero due to symmetry | Negligible coupling |
| TM 110 (E along Z) | none | Medium | Medium coupling |

In further embodiments of the present invention the coupling structure 130 can be adapted to couple directly to multiple resonant modes.

Figure 3A:
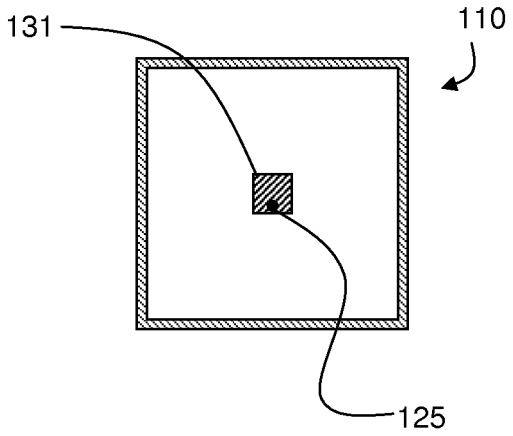
FIGS. 3A to 3G are schematic plan views of example coupling structures.

FIG. 3A shows a further coupling structure with an identically shaped patch element 131. The patch element could therefore be square as illustrated or any other shape (e.g. circle). However, the feedpoint 125 for feeding input signals to the patch element 131 or for extracting output signals from the patch element 131 is offset from the electrical centre of the patch element 131. In the illustrated embodiment, the feedpoint is located adjacent to an edge of the patch element, e.g. in the midpoint of an edge of the patch shape. In this embodiment, the offset is in a direction parallel to one side of the resonator body (and perpendicular to another), and particularly parallel to one side of the face of the resonator body on which the patch element is located.

The offset of the feedpoint from the patch centre causes the patch 131 to couple intentionally to a different single resonant mode of the resonator body (i.e. different to the coupling of the patch described in FIG. 1D), although some coupling to the existing mode may well remain, depending upon the exact feed position chosen and the shape of the patch. While the centrally fed, centrally located patch element in FIG. 1D coupled primarily to a resonant mode in the Z-direction (i.e. into the page), the patch 131 of FIG. 3A couples intentionally to a resonant mode in the Y direction, owing to the now stronger component of current in that direction. Whilst there may still be some coupling to modes in the Z-direction, coupling to modes in the X direction will be limited.

It is also worth examining the case of a small patch, where 'small' is defined as being small relative to the size required for the patch to be resonant at the input or output frequency of interest for the filter, such that there is a negligible variation of the E-field of the cube's Z-mode across the surface of the patch. In this case, the location of the feedpoint becomes essentially unimportant, since substantially only E-field coupling to the cube's Z-mode will occur (for a patch located at the centre of one face of the cube).

Figure 3B:
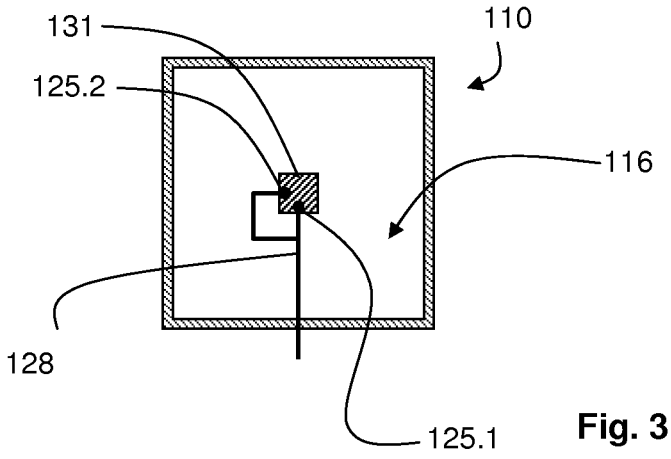

FIG. 3B shows a further example coupling structure 130 in which more than one feedpoint is used to input signals to or extract signals from the patch element 131. Again, the patch element can take any shape, as defined above. A first feedpoint 125.1 is coupled to a location on the patch element 131 which is offset from the electrical centre, as before. In this embodiment, however, a second feedpoint 125.2 is also coupled to the patch element at a second, different location offset from both the electrical centre and the first feedpoint 125.1. An input/output track 128 is also schematically illustrated, by which it can been that both feedpoints are connected to a common input/output track 128. In one embodiment the second feedpoint 125.2 is located in an adjacent side (or an adjacent corner, for example) to the first feedpoint 125.1. In this way, by appropriate design of the input/output track, circularly polarised fields can be generated in the resonator body 110, coupling to at least two modes simultaneously. This field could be left-hand polarised, right-hand polarised, linearly polarised, elliptically polarised or similar by appropriate design of the input/output track 128 as is known in the art.

Figure 3C:
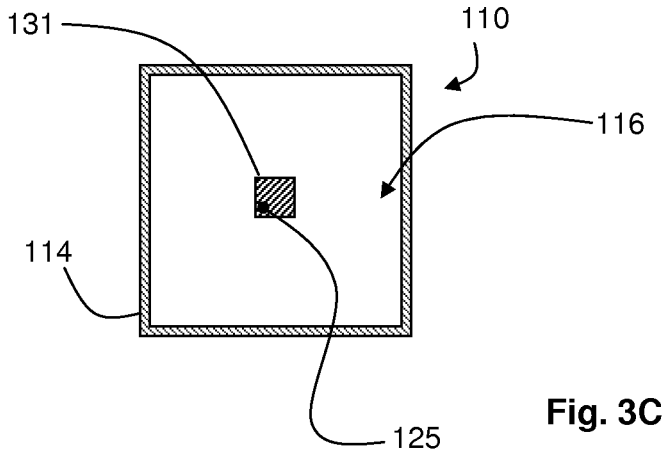

FIG. 3C shows a coupling structure 130 according to a yet further embodiment, in which the patch element 131 is again centrally located in a face of the resonator body 110. The patch element has a feedpoint 125 at a location which is offset in both the X and Y directions, i.e. towards a corner of the patch element. The current which is generated in the patch element as a result of this feedpoint location has substantially equal components in the X and Y directions, and thus the patch element couples strongly to two resonant modes of the resonator body 110: one resonant mode in the X direction and one resonant mode in the Y direction. Coupling to a resonant mode in the Z direction may be low, although some coupling to the Z-mode may well remain, depending upon the exact feed position chosen and the shape of the patch.

The relative amounts of X and Y mode excitation are determined by the position of the feedpoint relative to the relevant edges of the patch 131. So, for example, if the feedpoint location is moved slightly from the centre of a side generating X-mode excitation, toward a side generating Y-mode excitation, then the result will be a predominantly X-mode excitation, with a small amount of Y-mode excitation. As the deviation from the centre of the side (along that side) increases, the amount of Y-mode excitation also increases, until an equal amount of X and Y mode excitation occurs when the feedpoint is placed in the corner. An analogous situation exists when moving from the centre of a Y-mode exciting side (in this case introducing progressively greater levels of coupling to the X-mode).

Figure 3D:
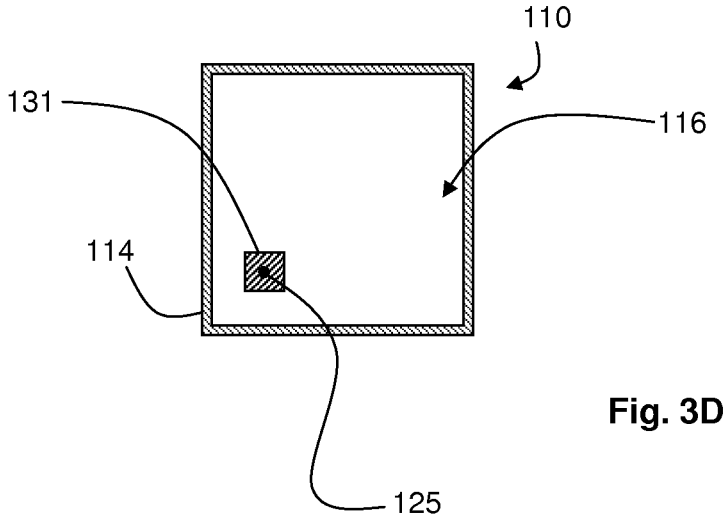

FIG. 3D shows a coupling structure 130 according to another embodiment in which the patch element 131 itself is located at a position which is offset from the centre of the face of the resonator body 110. A feedpoint 125 for feeding signals to the coupling structure 130 or extracting signals from the coupling structure 130 is located at a position which is coincident with the centre of the patch element 131. A patch element 131 located substantially at the centre of the face of the resonator body 110, having a substantially centrally located feedpoint 125, generates a very small H field in the form of a loop above the patch, and in a plane parallel to the patch. If the patch element 131 is offset from the centre of the face of the resonator body 110, then the H field is not balanced with respect to the X- and Y-mode H fields and, consequently, some coupling to those modes will occur. If the patch element 131 is displaced off centre in the X direction, then the H field will couple to the X mode. Similarly, a patch element 131 displaced off centre in the Y direction will have an H field that couples to the Y mode. However, the coupling strength in either case will be small.

Figure 3E:
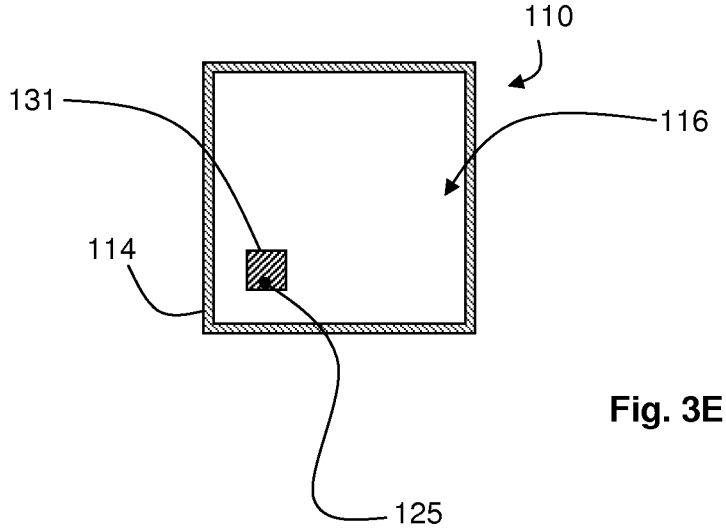

FIG. 3E shows a coupling structure 130 according to a yet further embodiment in which the patch element 131 is offset from the centre of the resonator body 110 face, and in which the feedpoint 125 is located at a position which is offset from the centre of the patch element 131. In the illustrated embodiment, the feedpoint is offset in a direction which is parallel or perpendicular to an edge of the resonator body 110 (similar to that shown in FIG. 3A). Due to both the offset of the patch element 131, and the offset of the feedpoint 125, coupling to the Z mode (i.e. into the page) can be controlled relative to the coupling to the X- and Y-modes. The offset of the feedpoint in the X direction causes a majority portion of the current in the patch element to move in that direction and thus there is also useful coupling to modes in the X direction. Coupling to the Y direction is low.

Figure 3F:
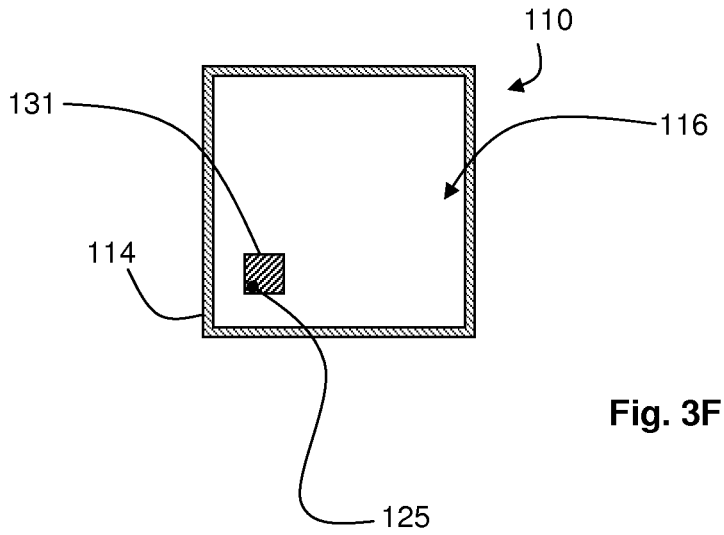

FIG. 3F shows a coupling structure 130 in which the patch element 131 is offset from the centre of the resonator body face, and in which the feedpoint 125 is offset from the centre of the patch element in a direction which is neither perpendicular nor parallel to an edge of the face in which the patch element is located (e.g. the feedpoint is offset in a direction towards the corner of the resonator body 110). In this embodiment, the coupling structure 130 provides controllable coupling to all three resonant modes of the resonator body 110.

Figure 3G:
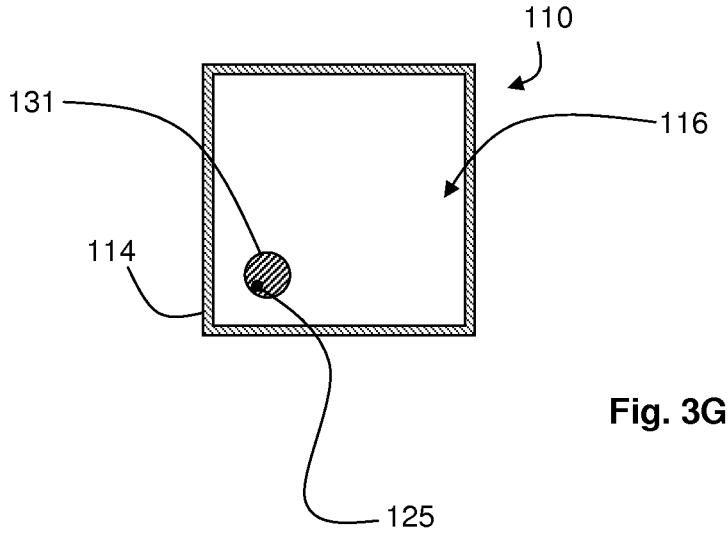

Finally, FIG. 3G shows a coupling structure 130 similar to that shown in FIG. 3F, but in which the patch element 131 is circular. The feedpoint 125 is offset from the centre of the patch element 131 in a direction which is nonparallel and nonperpendicular to the sides of the resonator body 110 and thus again provides coupling to all three modes.

It is again worth examining here the case of a small patch, where 'small' is defined as being relative to the size required for the patch to be resonant at the input or output frequency of interest for the filter, such that there is a negligible variation of the E-field of the resonator body's Z-mode across the surface of the patch. As noted above, the location of the feedpoint becomes essentially unimportant, since substantially only E-field coupling to the resonator body's Z-mode will occur (for a patch located at the centre of one face of the resonator body). However if the patch is located at a position offset from the centre of the face of the resonator body to which it is coupling, then a degree of coupling to one or more of the other modes (i.e. X and/or Y) will occur. The strength of the coupling achieved to the, or each, additional mode will depend upon the location of the patch relative to the metalized sides of the resonator body, but will not depend (to any significant degree) upon the location of the feedpoint within the area of the patch itself.

In all of the above cases, the following variables will determine the degree of coupling and the relative phase of the coupling provided to the multiple modes within the resonator body:

1) Patch size—Patch size primarily influences the degree of coupling. The strongest coupling occurs near to resonance when the patch has a resonant frequency equal to the frequency of one or more of the resonant modes of the resonator body. Progressively lower degrees of coupling occur with (relatively) significantly over- or under-sized patches (i.e. relative to the size which produces resonance).

2) Patch shape—square or circular patches will tend to produce a greater degree of E-field coupling than will an elongated shape (e.g. a rectangle or oval), so long as they are sufficiently large and are operating appreciably below their resonant frequency. In this case, the term 'sufficiently large' refers to patches which are large enough such that there is a significant variation of the E-field of the resonator body's Z-mode across the surface of the patch.

3) Location of the feed point (e.g. via) within the patch—a central location (with a square patch) will tend to result in a predominantly E-field being generated, whereas an offset location will introduce some H-field, in addition to the E-field.

4) Length of the transmission line feeding the patch—this can be used to determine the phase of the excitation fed into the resonator body at the patch location.

5) Impedance of the transmission line feeding the patch—this can be used to determine the amplitude of (or degree of) the excitation provided to the relevant mode(s) within the resonator body.

FIGS. 1D and 3A to 3G thus describe various coupling structures having a single patch element for coupling to one or more resonant modes in the resonator body 110. As described above, various techniques can be employed to ensure that the patch element can couple directly to more than one resonant mode. The patch element can, be fed from one or more feedpoints which are offset from the centre of the patch element. However, a designer of radio frequency filters may wish to use a single patch element and a central feedpoint, but which still couples to multiple modes. In that case, one or more defects can be added to the dielectric material 112 such that energy in one resonant mode couples to a further resonant mode. In this way, directly exciting a single mode indirectly excites one or more of the further modes of the resonator body 110. Further, if the patch element couples to two modes of the resonator body 110, one or more defects may be used to couple to the third mode. Generally, if coupling from one or more resonant modes to a single further mode, the design of the defect is simpler. Further still, defects may be employed to increase the coupling to a resonant mode of the resonator body which nonetheless is directly excited by the patch element. For example, if the patch element couples weakly to a particular resonant mode and strongly to another resonant mode, one or more defects may be used to couple more strongly to the weaker mode.

Figure 4:
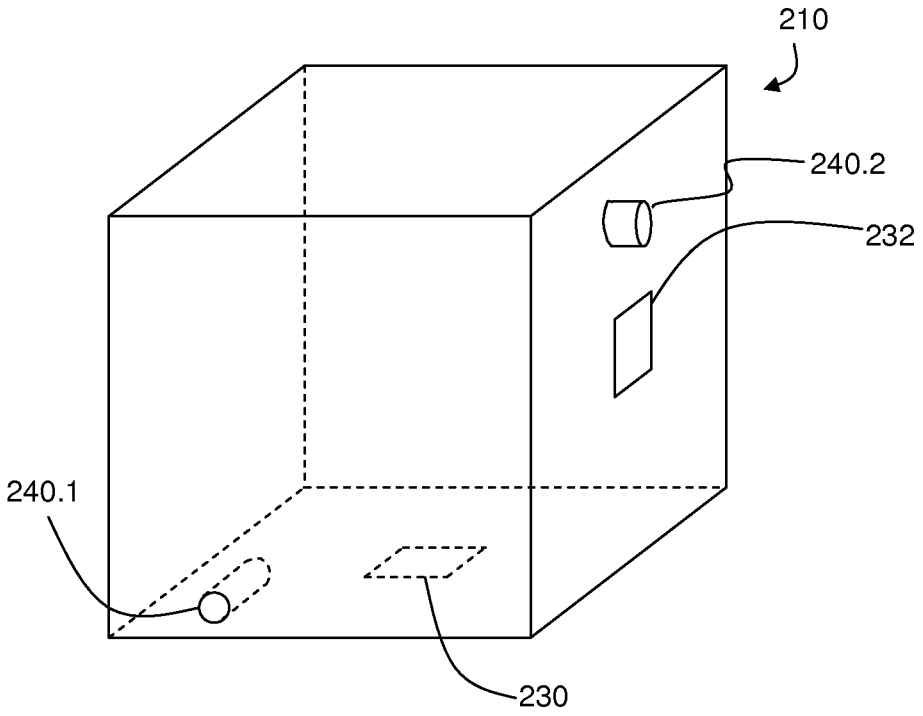
FIG. 4 is a three-dimensional schematic diagram of a resonator body.

FIG. 4 is a three-dimensional schematic diagram of a resonator body 210 which employs this technique. Dashed lines, in FIG. 4 and throughout, show features which would not ordinarily be visible from the viewpoint taken.

The resonator body 210 is again cuboid, as above, but could take any general shape capable of supporting a resonant mode and one or more degenerate modes. In the illustrated embodiment, in fact, the template of the resonator body is a shape which supports multiple modes which are independent of one another, i.e. in which excitement of one of the natural modes does not cause excitement of the other natural modes. A first coupling structure 230 is positioned on one face of the resonator body (for example, to input signals to the resonator body 210), and a second coupling structure 232 (for example, to output signals from the resonator body 210) is positioned on a different, adjacent face of the resonator body. In one embodiment the first and second coupling structures are similar to that described above with respect to FIG. 1D, i.e. they are not capable of directly coupling to more than one mode simultaneously. However, it will be appreciated that in other embodiments the first coupling structure, the second coupling structure or both coupling structures can take any of the forms described above, particularly with respect to FIGS. 1D, and 3A to 3G.

The relative positioning of the first and second coupling structures can also have an effect on the resonant modes which are excited in the resonator body 210. For example, by appropriate positioning of the first and second coupling structures, the modes can be forced to alter their behaviour in a beneficial manner (e.g. to alter—typically, increase—the coupling to one or more modes). For example, assuming the positioning of the first (i.e. input) coupling structure is fixed, the positioning of the second (i.e. output) coupling structure and/or the positioning of its feedpoints, can be adjusted to alter the coupling between modes, leading to stronger coupling to a particular mode or modes in addition to its role in extracting signals from the puck. If the filter is designed as a whole in this manner, then the addition of defects may be avoidable in many designs.

Although not illustrated, the coupling structures on the bottom and side faces could be connected to separate substrates (e.g. PCBs) to feed the signals to and from the patches. The two PCBs could then be connected together to provide a common interface to further circuitry. Alternatively, coaxial cable or other connection mechanisms could be used (notably for the side face), in order to link the two PCBs together.

In order to adjust the shape of the resonator body 210 such that excitation of one mode causes corresponding excitation of one or more further modes, one or more defects 240 are added to the resonator body as illustrated. In particular, a first defect 240.1 comprises a cut made in the piece of dielectric material. The cut can take any one of a number of different forms, but generally entails the removal of some material from the otherwise regular shape of the dielectric material. A second defect 240.2 comprises a protuberance of dielectric material, i.e. some additional material which projects from the surface of the resonator body. The protuberance again can take any shape or form.

These are only two examples of the huge range of defect types and locations which could be used to generate the same or similar results (i.e. that of enabling E-field coupling to achieve multi-mode excitation in the resonator body). The precise determination of the number, location, size and type of defects is thus an exercise for the designer. However, the general principles of defect location, type and size are:

1) The positioning of a defect close to an edge of the resonator body (i.e. the join of two sides) leads to stronger coupling between the originally excited mode and the coupled modes.

2) The positioning of a defect close to the centre (of an edge) leads to stronger coupling between the originally excited mode and the coupled modes.

3) The depth of penetration (or the size of the protuberance) of a defect also contributes to the strength of coupling between the originally excited mode and the coupled modes: the deeper the penetration, the greater the coupling.

4) The number of defects (e.g. holes) further contributes to the strength of the coupling between the originally excited mode and the coupled modes. The more holes (for example) of a given size, the greater the coupling, although this cannot be divorced from hole location. For example it is possible that the use of two holes located far from the centre of an edge could exhibit a smaller influence on coupling than a single hole of the same size, located at (or close to) the centre of the edge. Likewise, the same is true of the number of protuberances.

Note that any use of defects in this way will also have an influence on the resonant frequency of the resonator body 210, when compared to its unadulterated form. Whilst this is potentially undesirable, it is nevertheless predictable (in simulations conducted during the design process) and this frequency shift can be taken into account by appropriately re-sizing the resonator body 210.

FIGS. 5A to 5G illustrate some types of defects which may be employed in accordance with embodiments of the invention. Filters according to embodiments of the invention can employ one or more of any of these defects in a single resonator body 210 in order to appropriately couple the energy in one resonant mode of the resonator body 210 to one or more other resonant modes of the resonator body.

Figure 5A:
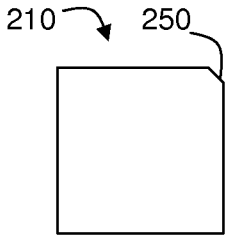
FIGS. 5A to 5G are schematic diagrams showing different types of defects.
Figure 5B:
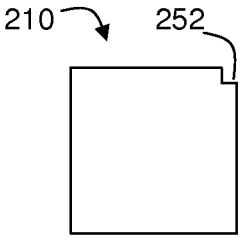
Figure 5C:
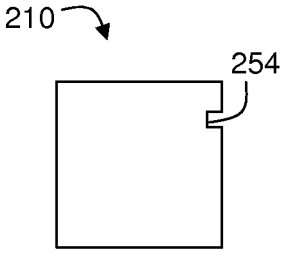
Figure 5D:
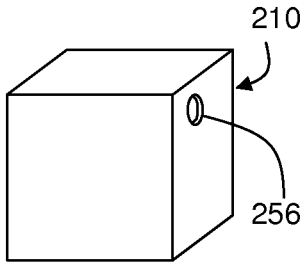
Figure 5E:
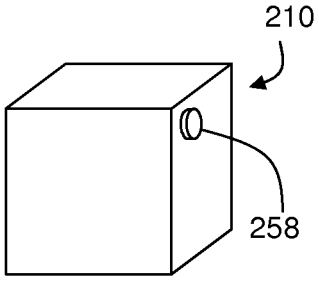
Figure 5F:
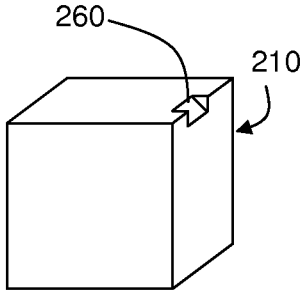
Figure 5G:
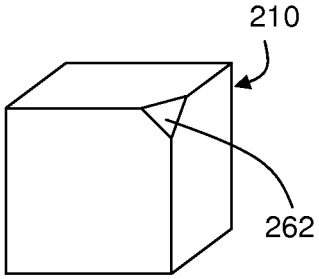

FIG. 5A shows a plan view of a resonator body 210 with a bevelled edge 250, i.e. a flat, angled cut which runs from corner to corner along the entire length of one side of the dielectric material. FIG. 5B shows a resonator body 210 with a recessed edge 252, i.e. a non-flat cut which runs from corner to corner across the entire length of one side of the dielectric material. FIG. 5C shows a resonator body 210 with a groove 254, i.e. a channel cut into the surface of the dielectric material, which runs from one edge of the dielectric material to another edge. The groove 254 may have angled, straight and/or curved sides as required. FIG. 5D shows a resonator body 210 with a recess 256, substantially as described before with respect to FIG. 4. Thus the recess 256 can be circular, as in the illustrated embodiment, or take any other shape as required. FIG. 5E shows a resonator body 210 with a protrusion 258, substantially as described above with respect to FIG. 4. In the illustrated embodiment the protrusion 258 is circular, but may take any shape as required. FIG. 5F shows a resonator body 210 with a partially bevelled edge 260 i.e. a flat, angled cut which runs along part of the length of one side of the dielectric material. Similarly, the recessed edge 252 described above with respect to FIG. 5B can run along the entire length of one edge of the dielectric material or just part of an edge of the dielectric material. FIG. 5G shows a resonator body 210 with a vertex cut 262, i.e. a flat angled cut across one of the vertices of the dielectric material. This latter defect has the advantage that it couples one resonant mode of the dielectric material to all other resonant modes of the dielectric material, i.e. it provides a surface which is non-perpendicular to all major axes of the resonator body.

In some scenarios, a single resonator body cannot provide adequate performance (for example, attenuation of out of band signals). In this instance, filter performance can be improved by providing two or more resonator bodies arranged in series, to thereby implement a higher-performance filter.

Figure 6:
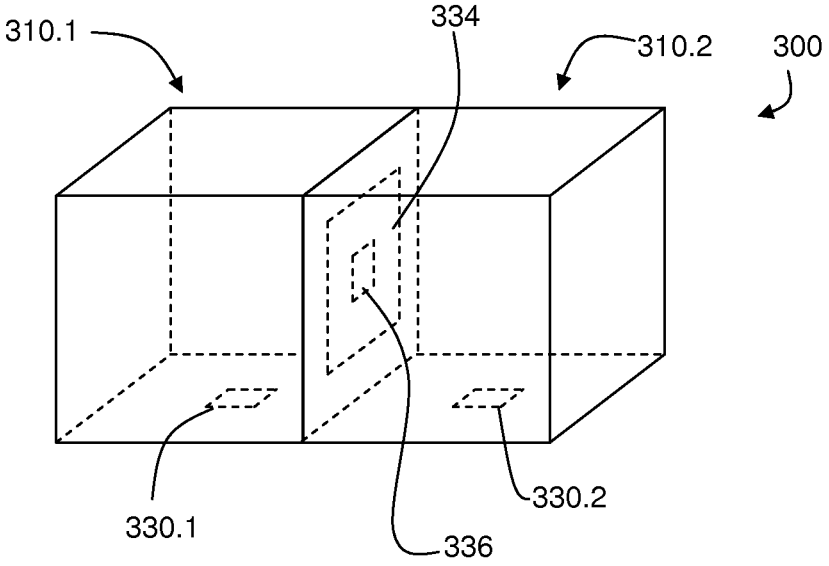
FIG. 6 is a schematic diagram showing the coupling of two resonator bodies together.

In one example, this can be achieved by providing two resonator bodies in contact with each other, with one or more apertures provided in the conductive coatings of the resonator bodies, where the bodies are in contact. This allows the fields in each cube to enter the adjacent cube, so that a resonator body can receive a signal from or provide a signal to another resonator body. When two resonator bodies are connected, this allows each resonator body to include only a single coupling structure, with a coupling structure on one resonator body acting as an input and the coupling structure on the other resonator body acting as an output. An example of such an arrangement will now be described with reference to FIG. 6.

In this embodiment, a filter 300 includes first and second resonator bodies 310.1, 310.2 mounted on a common substrate (not illustrated), and positioned adjacent to one another. In one embodiment, the first and second resonator bodies are placed in close contact. The substrate may again be a multilayer substrate providing external surfaces defining a common ground plane, as well as providing connection pads for input and output signals.

In this example, each resonator body 310.1, 310.2 is associated with a respective coupling structure 330.1, 330.2. As before, the coupling structures may be formed directly on the resonator body, arranged in an aperture in the conductive coating, or in an uppermost layer of the substrate. The coupling structures 330.1, 330.2 each consist of a single conductive patch element, and can take any of the forms described above, particularly with reference to FIGS. 1D and 3A to 3G. In particular, although square patches are shown in the Figure, it will be understood that the patches may take any shape as described above. An input signal is fed to the first coupling structure 330.1, and an output (filtered) signal is extracted from the second coupling structure 330.2.

Each resonator body 310.1, 310.2 comprises a further "coupling" aperture 334 in their conductive coating on their respective abutting surfaces. In this way, energy in the first resonator body 310.1 can be coupled to the second resonator body 310.2. In order to increase the coupling between the first and second resonator bodies, within the coupling apertures, a coupling patch element 336 (similar to those described above) may be provided, operably coupled to both resonator bodies (for example the coupling patch element 336 may be in contact with both resonator bodies or sufficiently close to enable energy to be extracted from the resonator bodies or excited in the resonator bodies). Alternatively, two electrically coupled coupling patches may be provided, a first coupling patch on the surface of the first resonator body 310.1, within its respective coupling aperture, and a second coupling patch on the surface of the second resonator body 310.2, within its respective coupling aperture.

It will therefore be appreciated that in this example, signals supplied via the first coupling structure 330.1 are filtered by the first and second resonator bodies 310.1, 310.2, before in turn being supplied to the output via the second coupling structure 330.2. Each resonator body supports three resonant modes and thus the filter 300 operates with a total of six modes.

Accordingly, the above described filter arrangements provide a simple yet effective mechanism for coupling signals to or from a resonator body, using a single patch element on, or close to, the surface of the resonator body. Coupling to multiple modes of the resonator body can be achieved in a number of different ways. For example, the shape of the resonator body may be adapted by introducing one or more defects, such that excitation of one mode indirectly causes excitation of further modes. In another example, the patch element may be given a shape with a low degree of symmetry, or driven from one or more feedpoints which are offset from the centre of the patch element.

The above described examples have focused on coupling to up to three modes. It will be appreciated this allows coupling to be to low order resonance modes of the resonator body. However, this is not essential, and additionally or alternatively coupling could be to higher order resonance modes of the resonator body.

Persons skilled in the art will appreciate that numerous variations and modifications will become apparent. All such variations and modifications which become apparent to persons skilled in the art are considered to fall within the spirit and scope of the invention broadly appearing before described.

The invention claimed is:

1. A cavity filter comprising:

a dielectric resonator structure including a piece of dielectric material having a shape supporting a first resonant mode and a second resonant mode, said second resonant mode being substantially degenerate with the first resonant mode;

and a coupling structure for exciting at least one of the first resonant mode and the second resonant mode within the piece of dielectric material or for extracting energy from at least one of the first resonant mode and the second resonant mode within the piece of dielectric material, wherein the coupling structure includes a single patch element in contact with a surface of the piece of dielectric material, the patch element being a substantially flat conductive element arranged to couple directly to said first and second resonant modes simultaneously, the cavity filter further including first and second feedpoints connected to the patch element for feeding input signals to the patch element or for receiving output signals from the patch element, wherein the first and second feedpoints are connected to the substantially flat conductive element so as to generate a circularly polarized field.

2. A cavity filter comprising:

a dielectric resonator structure including a piece of dielectric material having a shape supporting a first resonant mode and a second resonant mode, said second resonant mode being substantially degenerate with the first resonant mode; and a coupling structure for exciting at least one of the first resonant mode and the second resonant mode within the piece of dielectric material or for extracting energy from at least one of the first resonant mode and the second resonant mode within the piece of dielectric material, wherein the coupling structure includes a single patch element in contact with a surface of the piece of dielectric material, the patch element being a substantially flat conductive element arranged to couple directly to said first and second resonant modes simultaneously, the cavity filter further including first and second feedpoints connected to the patch element for feeding input signals to the patch element or for receiving output signals from the patch element, wherein the first and second feedpoints are connected to the substantially flat conductive element so as to generate a first linearly polarized field and a second linearly polarized field.

3. A cavity filter comprising:

a dielectric resonator structure including a piece of dielectric material having a shape supporting a first resonant mode and a second resonant mode, said second resonant mode being substantially degenerate with the first resonant mode; and a coupling structure for exciting at least one of the first resonant mode and the second resonant mode within the piece of dielectric material or for extracting energy from at least one of the first resonant mode and the second resonant mode within the piece of dielectric material, wherein the coupling structure includes a single patch element in contact with a surface of the piece of dielectric material, the patch element being arranged to couple directly to said first and second resonant modes simultaneously, the cavity filter further including a feedpoint connected to the patch element for feeding input signals to the patch element or for receiving output signals from the patch element, wherein the feedpoint is connected to the patch element at a location displaced from an electrical center of the patch element, wherein the patch element is located on a face of the piece of dielectric material, and wherein the feedpoint is displaced from the electrical center of the patch element in a direction oblique relative to sides of the face.

4. The cavity filter according to claim 3, wherein the substantially flat conductive element is adapted for generating an electric field at least partially for exciting the first resonant mode and a magnetic field at least partially for exciting the second resonant mode, or at least partially for extracting energy from an electric field of the first resonant mode and a magnetic field of the second resonant mode.

5. The cavity filter according to claim 3, wherein the patch element is located at a position which is offset from a center of the face.

6. The cavity filter according to claim 5, wherein the patch element is offset from a center of the face in a direction oblique relative to sides of the face.

7. The cavity filter according to claim 3, wherein the shape of the piece of dielectric material is such that excitation of the first resonant mode causes excitation of the second resonant mode.

8. The cavity filter according to claim 3, wherein the shape of the piece of dielectric material is such that the first resonant mode and the second resonant mode are capable of being simultaneously independently excited.

9. The cavity filter according to claim 3, wherein the piece of dielectric material is covered by a layer of conductive material, the layer of conductive material having an aperture in which the coupling structure is located.

10. The cavity filter according to claim 3, wherein the coupling structure is a first coupling structure for exciting a resonant mode within the piece of dielectric material or for extracting energy from a resonant mode within the piece of dielectric material, the cavity filter further comprising a second coupling structure for exciting a resonant mode within the piece of dielectric material or for extracting energy from a resonant mode within the piece of dielectric material.

11. The cavity filter according to claim 3, wherein the single patch element has a shape arranged to couple to the first and second resonant mode via at least one of E-field excitation and H-field excitation.

12. The cavity filter according to claim 3, wherein the piece of dielectric material is cuboid.

* * * * *